United States Patent [19]

Saito

[11] 4,347,821

[45] Sep. 7, 1982

[54] AIR/FUEL RATIO CONTROL SYSTEM FOR INTERNAL COMBUSTION ENGINE HAVING ROTARY VALVE AND STEP MOTOR

[75] Inventor: Masaaki Saito, Yokosuka, Japan

[73] Assignee: Nissan Motor Company, Limited, Yokohama, Japan

[21] Appl. No.: 185,436

[22] Filed: Sep. 9, 1980

[30] Foreign Application Priority Data

Sep. 13, 1979 [JP] Japan ..... 54-126638[U]

[51] Int. Cl.[3] ..... F02M 11/00; F02B 33/00; F02B 3/00; F02B 75/10

[52] U.S. Cl. ..... 123/440; 123/437; 123/585; 123/589

[58] Field of Search ..... 123/440, 437, 585, 589, 123/80 R; 60/276, 285; 261/121 B, 67; 251/59, 133, 304, 310; 137/351, 354, 355

[56] References Cited

U.S. PATENT DOCUMENTS 4,075,835 2/1978 Hattori et al. ..... 123/440
4,132,194 1/1979 Saito ..... 123/440
4,132,199 1/1979 Kuroiwa et al. ..... 123/440
4,181,108 1/1980 Bellicardi ..... 123/440

*Primary Examiner*—Raymond A. Nelli
*Attorney, Agent, or Firm*—Schwartz, Jeffery, Schwaab, Mack, Blumenthal & Koch

[57] ABSTRACT

A system for feedback control of the air/fuel mixing ratio in an internal combustion engine equipped with a carburetor. The control system has an air/fuel ratio detector of a gas sensor type which provides a feedback signal to a control circuit and a rotary valve which is operated by a stepping motor responsive to a control pulse signal produced by the control circuit to regulate the fuel feed rate so as to nullify a deviation of the detected actual air/fuel ratio from a preset air/fuel ratio. The control system may include two auxiliary air-admitting passages respectively connected to a main fuel passage and a slow fuel passage in the carburetor, and in this case the single rotary valve is designed and arranged so as to simultaneously control the admission of air into both of the two auxiliary air-admitting passages.

4 Claims, 11 Drawing Figures

HIGH LEVEL
LOW LEVEL

OUTPUT OF 92
OUTPUT OF 94

PHASE 1
PHASE 2
PHASE 3
ON
OFF
ON
OFF
ON
OFF
STEP 1
STEP 2
STEP 3
STEP 4
STEP 5
STEP 6
STEP 7

AIR/FUEL RATIO CONTROL SYSTEM FOR INTERNAL COMBUSTION ENGINE HAVING ROTARY VALVE AND STEP MOTOR

FIELD OF THE INVENTION

This invention relates to a feedback control system to control the air/fuel ratio of an air-fuel mixture supplied to an internal combustion engine, the control system being of the type having an air/fuel ratio detector of a gas sensor type and an electrically operated valve means for varying the rate of fuel feed from a carburetor to the engine in compliance with a control signal produced on the basis of a feedback signal provided by the detector.

BACKGROUND OF THE INVENTION

In internal combustion engines and particularly in automotive engines, it has become popular to perform feedback control of the air/fuel mixing ratio by utilizing an air/fuel ratio detector such as an oxygen sensor installed in an exhaust passage as a means for providing a feedback signal. For an engine equipped with a carburetor, it is usual to provide an electrically operated flow control valve means to either a fuel passage or an auxiliary air-admitting passage connected to a fuel passage and control the operation of this valve means by a control signal produced on the basis of an actual air/fuel ratio value detected by the sensor.

As the electrically operated flow control valve means, it is preferred to employ a solenoid valve of the on-off functioning type mainly because of its better responsiveness compared with other practicable methods such as the use of a needle valve operated by a linear solenoid or a stepping motor through a gear train. Where the air/fuel ratio control system utilizing a solenoid valve of the on-off functioning type is designed so as to control two fluid passages as in the case of controlling not only the rate of fuel feed through a main fuel discharge passage in a carburetor but also the rate of fuel feed through a slow fuel discharge passage of the same carburetor, it is indispensable to provide one solenoid valve for each fuel discharge passage, so that the control system must include two solenoid valves.

SUMMARY OF THE INVENTION

It is an object of the present invention to provide a feedback air/fuel ratio control system for an internal combustion engine equipped with a carburetor, the system being so constructed as to minutely control the rate of fuel feed to the engine based on a feedback signal provided by an air/fuel ratio detector fundamentally similar to a conventional air/fuel ratio control system but employing a new type of electrically operated flow control valve means that enables the simultaneous control of two fluid passages without increasing the number of the valve means.

The present invention provides an air/fuel ratio control system for an internal combustion engine equipped with a carburetor, the control system having an air/fuel ratio detector that produces an electrical feedback signal representative of an actual air/fuel ratio of an air-fuel mixture supplied to the engine, an electrically operated flow control valve means for minutely varying the rate of fuel feed from the carburetor to the engine and a control circuit which provides a control signal to the valve means so as to nullify any deviation of the actual air/fuel ratio represented by the feedback signal from a preset air/fuel ratio. A primary feature of the invention resides in that the flow control valve means in the control system is a rotary valve operated by a stepping motor which is driven in compliance with the control signal.

As a preferred embodiment, a principal part of the rotary valve is constituted of an outer hollow cylinder which is formed with a plurality of circumferentially arranged radial apertures with circumferentially equal intervals therebetween and fixedly held in a valve body and an inner hollow cylinder which is formed with the same number of circumferentially arranged radial apertures with circumferentially equal intervals therebetween and rotatably fitted into the outer cylinder such that the rotary valve alternately takes an open state, where the respective apertures of the inner cylinder and the outer cylinder are in alignment, and a closed state, where the apertures of the inner cylinder are completely deviated from the apertures of the outer cylinder, as the inner cylinder is rotated stepwise by the stepping motor. The durations of the respective steps in the rotation of the stepping motor and accordingly the durations of the open state and closed state of the rotary valve are variably controlled by the control signal which is a phase- or duration- modulated pulse signal.

Because of the possibility of forming the outer and inner cylinders with a plurality of radial apertures, the rotary valve can be made to have two fluid outlets, so that it becomes possible to simultaneously control two fluid passages by a single rotary valve and a single stepping motor.

Advantageously, the invention can be embodied in an air/fuel ratio control system having a first auxiliary air-admitting passage connected to a main fuel discharge passage in a carburetor and a second auxiliary air-admitting passage connected to a slow fuel discharge passage in the same carburetor and a single rotary valve which is associated with both the first and second auxiliary air-admitting passages and operated by a single stepping motor.

Other than the possibility of controlling two fluid passages by a single rotary valve, an air/fuel ratio control system according to the invention is advantageous in that the control can be performed with high precision and good responsiveness and that the rotary valve does not exhibit significant changes in its performance characteristics such as responsiveness, accuracy and smoothness of rotation even when used for a long period of time.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DESCRIPTION OF THE PREFERRED EMBODIMENTS

Figure 1:
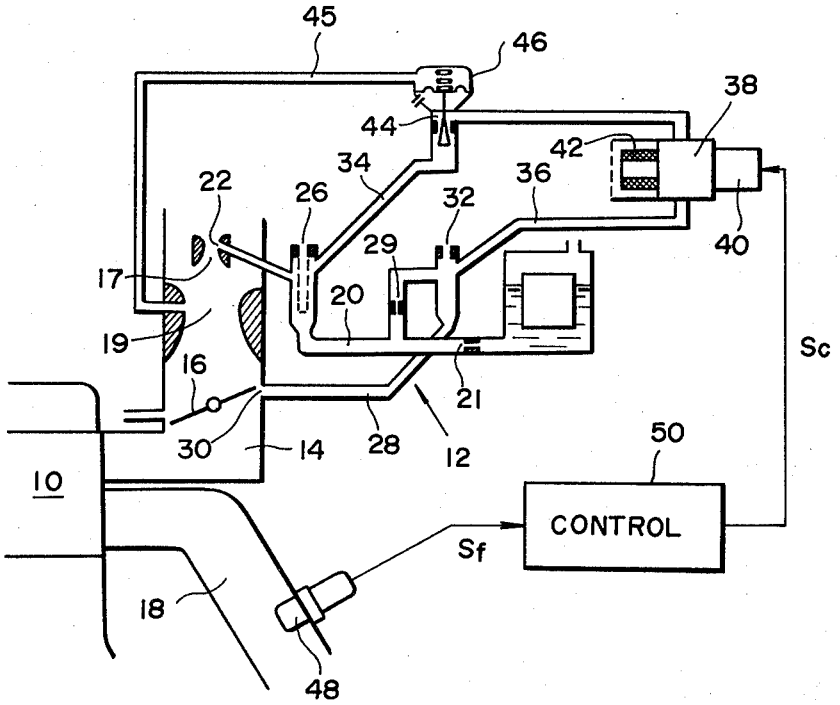
FIG. 1 is a schematic illustration of a fuel supply system for an internal combustion engine provided with an air/fuel ratio control system embodying the present invention.

FIG. 1 illustrates the application of the present invention to an automotive internal combustion engine generally indicated at 10 equipped with a conventional carburetor generally indicated at 12. An induction passage 14 with the provision of a throttle valve 16 and an exhaust passage 18 are provided to the engine 10 in the usual manner.

In the carburetor 12, a main fuel discharge passage 20 extends to terminate at a main nozzle 22 that opens into the induction passage 14 at a secondary venturi 17 located upstream of a main venturi section 19. A main air bleed 26 is provided to the main fuel passage 20 in the usual manner at a section between a metering jet 21 and the main nozzle 22. Also, there is a slow fuel discharge passage 28 which terminates at a slow port 30 opening into the induction passage 14 at a section near the throttle valve 16, and a slow air bleed 32 is provided to this fuel passage 28 in the usual manner at a section between a metering jet 29 and the slow port 30.

To control the air/fuel ratio of an air-fuel mixture supplied to the engine 10 through the induction passage 14 by minutely varying the rate of fuel discharge from the carburetor 12, an auxiliary air-admitting passage 34 is provided to the main fuel passage 20 at a section near the main air bleed 26, and another auxiliary air-admitting passage 36 for the same purpose is connected to the slow fuel passage 28 at a section near the air bleed 32. A rotary valve 38, which is operated by a magnetic stepping motor 40 (sometimes called a pulse motor), is associated with these two auxiliary air-admitting passages 34 and 36 to control the admission of air into these passages 34, 36 through an air filter 40.

To detect actual air/fuel ratio of a mixture subjected to combustion in the engine 10 by detecting the concentration of a specific component of the exhaust gas, an exhaust sensor 48 is disposed in the exhaust passage 18 to provide an electrical signal $S_f$ representative of the detected gas concentration or actual air/fuel ratio to an electronic control unit 50, which produces a control signal $S_c$ in the form of a pulse signal based on the direction and magnitude of a deviation of the actual air/fuel ratio represented by the feedback signal $S_f$ from a preset air/fuel ratio. A typical example of the exhaust sensor 48 is an oxygen sensor of the oxygen concentration cell type having a layer of an oxygen ion conductive solid electrolyte, such as zirconia stabilized with calcia or yttria, with electrode layers coated on the two opposite sides thereof. Alternatively to the exhaust sensor 48, it is possible to utilize an air/fuel ratio detecting device (not shown) disposed in the induction passage 14. In response to each pulse of the control signal $S_c$, the stepping motor 40 produces a step of a definite angular motion, for example 30° per step, and the rotary valve 38 alternately takes an open state where air is admitted into the auxiliary air-admitting passages 34, 36 and a closed state where the admission of air into these passages 34, 36 is interrupted according as the stepping motor 40 rotates stepwise. The control unit 50 is so constructed as to vary the proportion of the open-state period of the rotary valve 38 to the closed-stae period depending on the direction of the deviation of the detected actual air/fuel ratio from the preset air/fuel ratio. That is, when the actual air/fuel ratio is lower than the preset air/fuel ratio the mentioned proportion is increased to thereby admit increased quantities of air into the auxiliary air-admitting passages 34, 36 and as a consequence decrease the rate of fuel discharge into the induction passage 14. When the actual air/fuel ratio is higher than the preset ratio, the mentioned proportion is decreased to thereby increase the rate of fuel discharge into the induction passage 14. This means that the control signal $S_c$ is produced by the employment of a pulse-duration modulation technique or a pulse-phase modulation technique.

Optionally, the auxiliary air-admitting passage 34 is formed with a variable-area orifice 44 with the provision of a vacuum-operated valve mechanism 46 which is connected by a vacuum-transmitting conduit 45 to the main venturi section 19 of the induction passage 14 such that the quantity of air admitted into fuel through the auxiliary air-admitting passage 34 is decreased as the magnitude of vacuum at the venturi section becomes greater.

Figure 3:
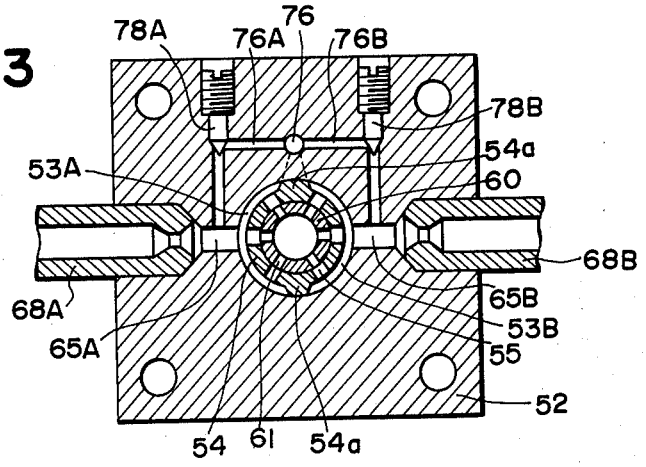
FIG. 3 is a cross-sectional view taken along the line 3—3 of FIG. 2.
Figure 2:
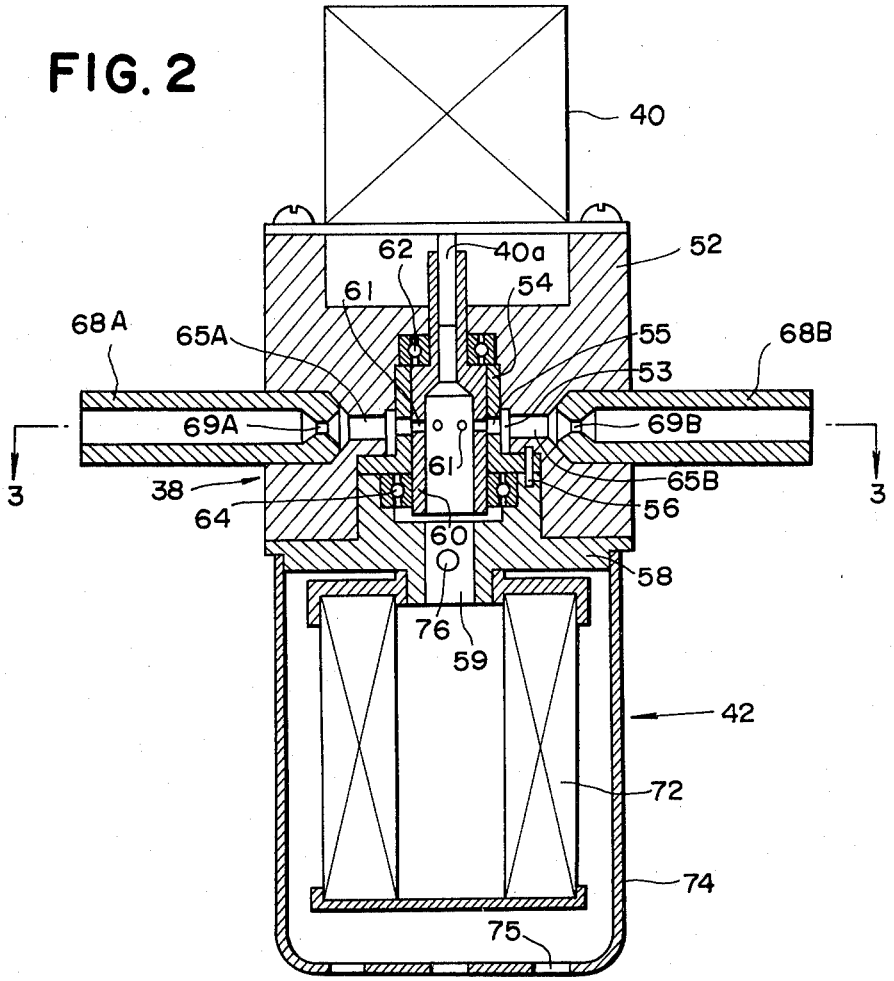
FIG. 2 is a longitudinal sectional view of a rotary valve unit employed in the air/fuel ratio control system of FIG. 1.

FIGS. 2 and 3 show a preferred construction of the rotary valve 38 which is assembled with the stepping motor 40 and the air filter 42 to constitute an integrated valve unit.

Principally, the rotary valve 38 is constituted of a valve body 52 formed with a suitably shaped cavity, an outer hollow cylinder 54 fixedly fitted into the cavity of the body 52, an inner hollow cylinder 60 concentrically and rotatably fitted into the outer cylinder 54, another body 58 assembled with the body 52 to secure the outer cylinder 54 and bearings 62, 64 respectively held by the bodies 52 and 58 so as to rotatably support the inner cylinder 60. For example, the outer cylinder 54 is flanged at its one end and fixed to the bodies 52 and 58 by means of locating pins 56. The stepping motor 40 is fixed to the valve body 52 by means of machine screws, and a driving shaft **40*a* of the stepping motor 40 is fitted into and fixed to an axially protruding portion of the inner cylinder 60. The body 58 is formed with an air inlet passage 59 which communicates with the atmosphere through the air filter 42 and is axially in alignment with the cylindrical space in the inner cylinder 60**.

The outer cylinder 54 is formed with a plurality of radial apertures 55 at circumferentially equal intervals therebetween, and the inner cylinder 60 is formed with the same number of radial apertures 61 at circumferentially equal intervals therebetween such that these apertures 61 can alternately be brought into first position where the apertures 61 are respectively in alignment with the apertures 55 of the outer cylinder 54 and second position where the apertures 61 are all deviated from the apertures 55 of the outer cylinder 54 as the inner cylinder 54 is rotated stepwise by the stepping motor 40. That is, the number of the apertures 55 and 61 are determined depending on the number of steps to complete 360°-rotation of the stepping motor 40. In the illustrated case the stepping motor 40 makes a 360°-rotation in 12 steps, i.e. 30°-per-step rotation, so that the outer and inner cylinders 54 and 60 are formed with six radial apertures 55 and 61, respectively. Of course, this rotary valve 38 is in the open state only when the apertures 61 of the inner cylinder 60 are in alignment with the apertures 55 of the outer cylinder 54.

The cavity in the body 52 is shaped such that an annular space 53 is formed around the outer circumference of the outer cylinder 54 in a small area containing the apertures 55, and the wall of the outer cylinder 54 has two radial projections 54*a* which partition the annular space 53 into two semicylindrical sections 53A and 53B. Thus, these spaces 53A and 53B communicate with the air inlet passage 59 through the apertures 55 and 61 when the rotary valve 38 is in an open state. In the body 52, two air passages 65A and 65B extend outwardly respectively from the two semicylindrical spaces 53A and 53B, and two tubular connectors 68A and 68B each formed with an orifice 69A, 69B are fixedly inserted into the body 52 to connect the air passage 65A with the auxiliary air-admitting passage 34 in FIG. 1 and the air passage 65B with the other auxiliary air-admitting passage 36.

The air filter 42 is fundamentally constituted of a filter element 72 attached to the body 58 to enclose therein the filter element 72 and formed with air-admitting apertures 75. The air inlet passage 59 formed in the body 58 opens into the clean-side space in the filter element 72.

Preferably, a vent passage 76 is formed in the bodies 58 and 52 so as to extend from the air inlet passage 59 and branch out into two vent passages 76A and 76B respectively extending to the two air passages 65A and 65B without passing through the apertures 55, 61 of the outer and inner cylinders 54, 60, and adjusting screws 78A and 78B are inserted into the body 52 so as to minutely adjust effective cross-sectional areas of the vent passages 76A and 76B, respectively. This vent system makes it possible to keep leakage of air through a very narrow gap between the outer and inner cylinders 54 and 60 at a practically constant scale, so that a sufficient precision in the flow rates of fuel in the main and slow fuel discharge passages 20 and 28 can be maintained even when the outer and inner cylinders 54 and 60 are manufactured with moderate precision desired from the viewpoint of reducing the production cost.

A rotary valve constructed fundamentally as described above can be used not only for the control of admission of auxiliary air but also for direct control of the flow rate of fuel in a fuel discharge passage in a carburetor.

Figure 4:
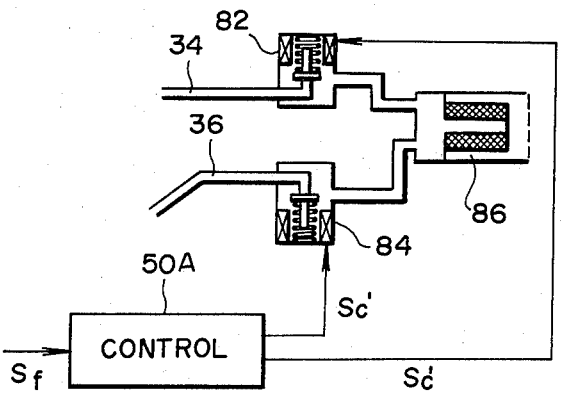
FIG. 4 (PRIOR ART)
FIG. 4 shows the arrangement of two electromagnetic flow control valves in a conventional air/fuel ratio control system analogous to the control system of FIG. 1.

As mentioned hereinbefore, there is a conventional air/fuel ratio control system analogous to the control system shown in FIG. 1 excepting the employment of the rotary valve 38 for the control of the admission of auxiliary air. FIG. 4 illustrates the method of controlling the admission of air into the auxiliary air-admitting passages 34 and 36 in such a conventional control system. In this case, a solenoid valve 82 of the on-off functioning type is associated with the auxiliary air-admitting passage 34 connected to the main fuel passage, and another solenoid valve 84 of the same type is associated with the auxiliary air-admitting passage 36 connected to the slow fuel discharge passage. Indicated at 86 is an air filter common to the two air-admitting passages 34 and 36. An electronic control unit 50A corresponding to the control unit 50 in FIG. 1 receives the output $S_f$ of the exhaust sensor and provides a control signal $S'_c$ in the form of a pulse signal to the respective solenoid valves 82 and 84 to control the proportion of the on-period to off-period of the solenoid valves 82, 84 based on the direction and magnitude of deviation of the detected actual air/fuel ratio from the preset ratio.

Figure 5:
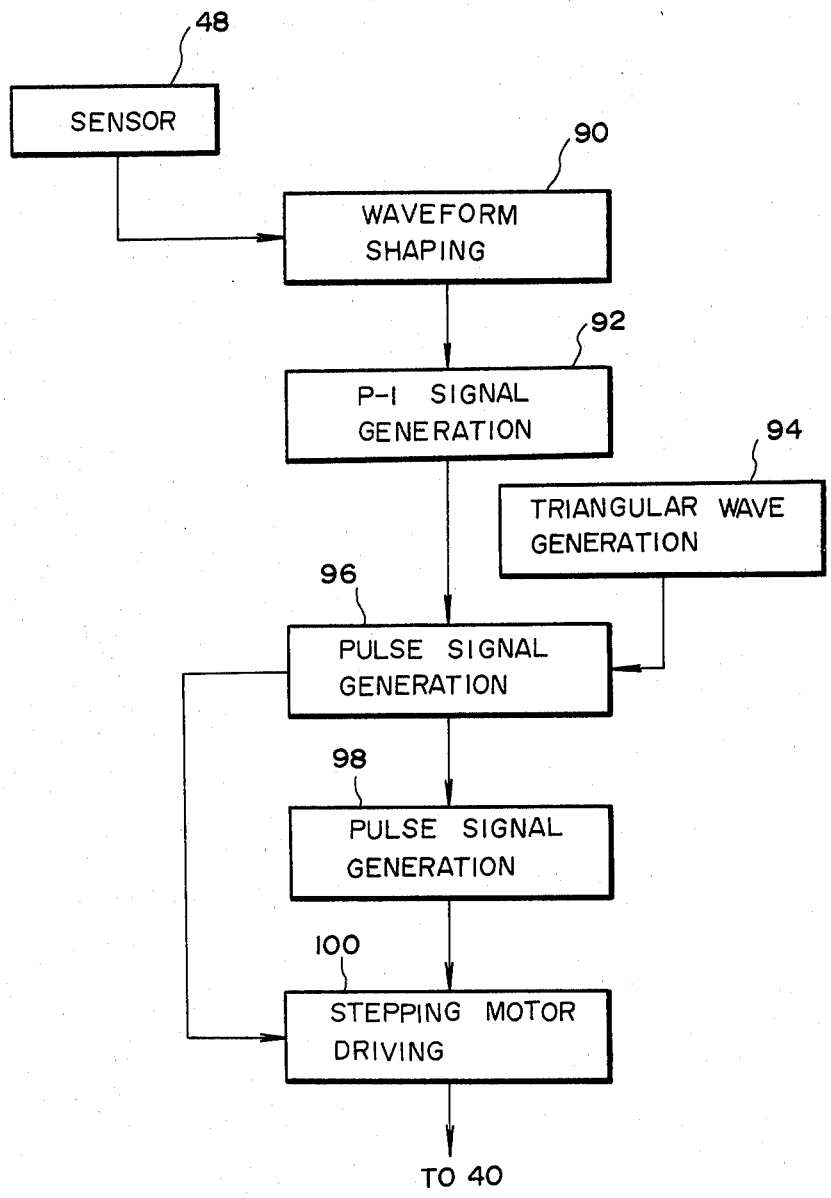
FIG. 5 is a block diagram showing an exemplary construction of a control circuit to drive a stepping motor which governs the rotary valve in the system of FIG. 1.

Returning to the present invention, an exemplary method of controlling the operation of the stepping motor 40 in the air/fuel ratio control system of FIG. 1 will be described with reference to the block diagram of FIG. 5 and the waveform charts of FIGS. 6(A) to 6(F).

Figures 6A, 6B, 6C, 6D, 6E, 6F:
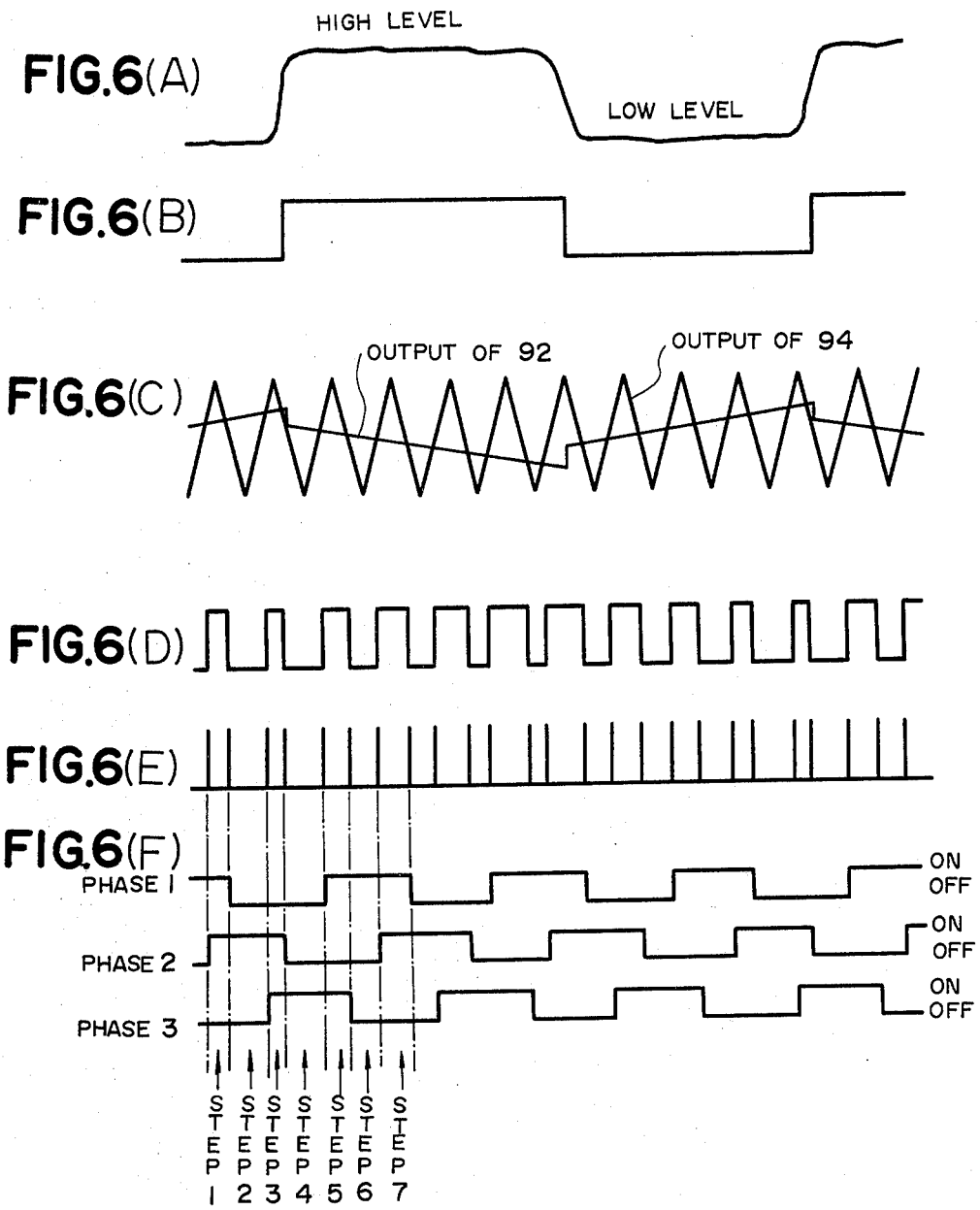
FIGS. 6(A) to 6(F) are charts showing the waveforms of electrical signals treated or produced in the control unit shown in FIG. 5.

In this case the aim of the air/fuel ratio control is to maintain a stoichiometric air/fuel ratio, and the exhaust sensor 48 is an oxygen sensor of the aforementioned oxygen concentration cell type. In the exhaust gas, this oxygen sensor produces an output voltage which remains at a high level while the engine 10 is fed with a fuel-rich mixture and at a distinctly low level while the engine is fed with a lean mixture. FIG. 6(A) shows the waveform of the output of this oxygen sensor. The control unit 50 has a waveform shaping circuit 90 to modify the output voltage of the oxygen sensor 48 into a square wave as shown in FIG. 6(B). The output of this shaping circuit 90 is put into a P-I signal generating circuit 92 which includes a proportional amplifier, an integrating amplifier and an adder to produce a proportional-integral (P-I) control signal as shown in FIG. 6(C) based on the durations of the high and low levels of the output of the oxygen sensor 48. Meanwhile, a triangular wave generating circuit 94 in the control unit 50 continues to produce a triangular wave of a constant frequency also as shown in FIG. 6(C). The outputs of these two circuits 92 and 94 are both supplied to a pulse signal generating circuit 96 which produces a duration-modulated pulse signal as shown in FIG. 6(D) by utilizing the triangular wave and the P-I control signal shown in FIG. 6(C). (In the conventional control system mentioned with reference to FIG. 4, the pulse signal of FIG. 6(D) serves as the control signal $S'_c$.) The control unit 50 has another pulse generating circuit 98 which transforms the duration-modulated pulse signal of FIG. 6(D) into a phase-modulated pulse signal as shown in FIG. 6(E). The control signal $S_c$ in FIG. 1 refers to this pulse signal, but actually this pulse signal is supplied to a stepping motor driving circuit 100 which may be included in the control unit 50 or may alternatively be provided to the stepping motor 40 as a separate circuit.

The stepping motor 40, which makes a 30° angular displacement per step as mentioned hereinbefore, is assumed to be of a three-phase type and driven by a sequential excitation method wherein windings of one phase and two phases are energized alternately in response to each pulse of the pulse signal of FIG. 6(E). The manner of the selective and sequential excitation of the windings of the first, second and third phases is shown in the following Table and illustrated in FIG. 6(F).

| | 1st phase | 2nd phase | 3rd phase | Rotary Valve |
|---|---|---|---|---|
| 1st step | ON | ON | OFF | OPEN |
| 2nd step | OFF | ON | OFF | CLOSED |
| 3rd step | OFF | ON | ON | OPEN |
| 4th step | OFF | OFF | ON | CLOSED |
| 5th step | ON | OFF | ON | OPEN |
| 6th step | ON | OFF | OFF | CLOSED |
| 7th step (= 1st step) | ON | ON | OFF | OPEN |

According as the stepping motor 40 is rotated stepwise, the inner cylinder 60 of the rotary valve 38 rotates stepwise with a 30° angular motion per step an alternately takes the open state and the closed state. The durations of the respective steps are different and determined by the variable pulse intervals of the pulse signal of FIG. 6(E). Accordingly, the admission of air into the auxiliary air-admitting passages 34 and 36 can be controlled in an on-off manner with controlled variations in the proportion of the on-duration to the off-duration.

When the stepping motor 40 is driven by the above described sequential excitation method, the open or closed state of the rotary valve 38 can easily be detected because it is permitted to assume that the rotary valve 38 is in the open state while the windings of two phases are energized simultaneously. Alternatively, it is possible to detect the state of the rotary valve 38 by using a certain revolution sensor associated with the inner cylinder 60.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In an air/fuel ratio control system for an internal combustion engine equipped with a carburetor which has a main fuel discharge passage provided with an air bleed and a slow fuel discharge passage provided with an air bleed, the control system having an air/fuel ratio detector which produces an electrical feedback signal representative of an actual air/fuel ratio of an air-fuel mixture supplied to the engine, a first auxiliary air-admitting passage connected to the main fuel discharge passage, a second auxiliary air-admitting passage connected to the slow fuel discharge passage, electrically operated flow control valve means for controlling the admission of air into the first and second auxiliary air-admitting passages and a control circuit which provides a control signal to the valve means so as to nullify a deviation of the actual air/fuel ratio represented by the feedback signal from a preset air/fuel ratio, wherein said flow control valve means is a single rotary valve operable to simultaneously control the admission of air into both said first and second auxiliary air-admitting passages and operated by a single stepping motor which is driven in compliance with said control signal;

said rotary valve comprising a hollow outer cylinder fixedly held in a valve body and formed with a plurality of circumferentially arranged radial apertures with circumferentially equal intervals therebetween, and a hollow inner cylinder formed with the same number of circumferentially arranged radial apertures as said apertures of said outer cylinder with circumferentially equal intervals therebetween and rotatably fitted into said outer cylinder whereby said inner cylinder is rotated stepwise by said stepping motor to alternately assume a first position wherein the respective radial apertures of said inner cylinder are aligned with the respective radial apertures of said outer cylinder and a second position where the radial apertures of said inner cylinder are deviated from the radial apertures of said outer cylinder.

2. An air/fuel ratio control system according to claim 1, wherein said rotary valve is arranged whereby a fluid subject to control flows into a space in said inner cylinder from an open end of said inner cylinder and flows out through the radial apertures of said inner and outer cylinders when said cylinder assumes said first position.

3. An air/fuel ratio control system according to claim 2, wherein said valve body is formed with an annular space around the circumferential outer surface of said outer cylinder in a limited area containing said radial apertures, said outer cylinder being formed with two radial projections in said limited area so as to partition said annular space into a first semicylindrical space communicating with a half of said radial apertures of said outer cylinder and a second semicylindrical space communicating with the other half of said radial apertures of said outer cylinder, said valve body being formed with two fluid outlet passages respectively extending outwardly from said first and second semicylindrical spaces.

4. An air/fuel ratio control system according to claims 2 or 3, wherein said valve body is formed with a vent passage which bypasses closable fluid passages provided by said outer and inner cylinders, said rotary valve further comprises at least one adjustable constricting means each arranged to vary an effective cross-sectional area of said vent passage.

* * * * *